United States Patent [19]

Izzo

[11] Patent Number: 5,042,704

[45] Date of Patent: Aug. 27, 1991

[54] DUAL STRAP CARRYING SYSTEM FOR GOLF BAGS

[76] Inventor: Theodore-James Izzo, 6490 Kinney Creek Rd., Evergreen, Colo. 80439

[21] Appl. No.: 499,595

[22] Filed: Mar. 23, 1990

Related U.S. Application Data

[63] Continuation-in-part of Ser. No. 460,406, Jan. 3, 1990.

[51] Int. Cl.[5] ..... A45F 3/04; A63B 55/00

[52] U.S. Cl. ..... 224/209; 224/202; 206/315.3; 206/315.5

[58] Field of Search ..... 224/208, 207, 202, 210, 224/211, 212, 213, 214, 215, 216, 201, 203–206, 259, 264; 206/315.1, 315.2, 315.3, 315.5, 315.7, 315.4, 315.6, 315.8; 273/32 E

[56] References Cited

U.S. PATENT DOCUMENTS

| | | | |
|---|---|---|---|
| 2,820,498 | 1/1958 | Endee | 224/202 |
| 2,853,111 | 9/1958 | Williams | 206/315.5 |
| 3,882,914 | 5/1975 | Strutz | 206/315.3 |
| 4,074,839 | 2/1978 | Wood et al. | 224/212 |

*Primary Examiner*—Charles E. Phillips

*Assistant Examiner*—David J. Walczak

*Attorney, Agent, or Firm*—John E. Reilly

[57] ABSTRACT

A golf bag carrying system, in the form of a dual strap carrier, includes a first and a second strap secured to the golf bag to define arm and shoulder openings. The straps have shoulder pads, and one of which may be covered with a relatively slick material. The first strap second end and the second strap first end are attached to a mid-portion of the bag at a central location. The other ends of the first and second straps are secured to the golf bag longitudinally on opposite sides of the central location. The straps include a first and second resilient strap elements at the central location, and the resilient elements terminate at a location spaced from the shoulder pads. These resilient strap elements position thus the straps for easy access. The first, second and third mounts for securing the straps to the bag are selectively adjustable longitudinally along the bag to balance the bag and to adjust for shoulder width. Also, the pads may be laterally arcuate to facilitate wear. Furthermore, a concavity shaped structure may be formed in the bag to conform to the golfer's back.

14 Claims, 5 Drawing Sheets

DUAL STRAP CARRYING SYSTEM FOR GOLF BAGS

RELATED APPLICATION

The present invention is a continuation-in-part of my application Ser. No. 460,406.

FIELD OF THE INVENTION

The present invention relates to golf bags and, more particularly, to apparatus used in conjunction with golf bags to facilitate transport thereof by a person. Specifically, the present invention is directed to a dual strap golf bag carrying device whereby a person may carry a golf bag either with a pair of straps placed across both shoulders and with the golf bag resting against his/her back or with a single strap in the traditional manner.

BACKGROUND OF THE INVENTION

The game of golf is one of the most widely enjoyed sports activities in the world. The number of persons participating in this activity, both at the professional and recreational level, is almost unparalleled. Not only is this activity already widespread, but also the ranks of golfers continue to swell at an unprecedented rate.

The sport of golf is typically played on a course consisting of nine or eighteen holes. A set of clubs is used to strike a golf ball along each hole comprising the course. Each hole consists of a tee box which defines a starting location wherein a golfer places a ball and initially strikes the ball towards a green. Each green includes a recessed cup, and it is the object of the golfer to strike the ball with a series of strokes into the cup. Different clubs are used to vary the height, distance and spin of the ball. The holes normally vary in length from short holes of approximately one hundred yards to longer holes of five hundred yards and greater. The holes are flanked by rough areas out of which it is more difficult to play, and hazards are provided to increase the intricacy and precision required in play.

Golfers may travel over a course during play in a variety of manners. For example, a golfer may walk a course and carry his/her clubs or sometimes employs another to carry clubs for him/her. Other golfers employ wheeled pull carts which mountably receive a set of clubs so that a golfer may push or pull the cart as the golfer walks each hole. Motorized or engine driven carts are available at some courses and, in fact, are required for play at certain courses. Here, a golfer mounts his/her clubs on the motorized cart and drives across the course from ball lie to ball lie.

The present invention concerns those persons who walk a golf course and carry their own golf bag and clubs. This invention is thus useful for a substantial number of golfers who desire walking a golf course as a means of a healthy, enjoyable exercise. One of the drawbacks which has long existed for these golfers prior to the present invention, however, is the nature of the construction of the standard golf bag. Here, the typical golf bag which receives the set of clubs is in the form of a tubular carrying member enclosed at one end so that the shafts of the clubs may be longitudinally received in the bag. A single strap extends from an upper rim of the golf bag to a mid-point on the bag. The golfer or the caddy then carries such bag by inserting one arm through the strap so that the strap extends a cross one shoulder thus supporting the bag for travel. A small handle may also be mounted on the bag, normally between the end points of the strap, to enable the bag to be carried by the human hand.

A disadvantage to this system has long been present, though, and is readily realized by persons who carry golf bags over a golf course. This problem results from the fact that the entire weight of the golf clubs and ba, which may typically be on the order of twenty to twenty-eight pounds, strains the muscles of the neck and shoulders unduly and further causes muscular strain resulting from the imbalanced nature of this method of carriage. Indeed, the imbalance can cause associated muscle soreness in the hips and lower back due to the fact that the center of gravity of the bag is offset with respect to the spine. This is of particular concern to those golfers who experience back problems.

Despite the long-felt need for a better carrying system for golf bags, there has been virtually no development of alternates to the above-described structure. There is such a need for a carrying system that can be manufactured both by original equipment on a golf bag and which can be retrofit onto standard golf bags. There is a further need for such a carriage system that is simply to use and enhances the game of golf for those who normally carry their golf bags.

SUMMARY OF THE INVENTION

It is an object of the present invention to provide a new and useful golf bag carrying system which may be employed by persons who carry golf bags during a round of golf.

Another object of the present invention is to provide an improved strap assembly for carrying golf bags which may be employed as a retro-fit system or combined with the construction of a golf bag when it is originally produced.

A further object of the present invention is to provide a dual strap system to allow a golf bag to be centered on the back of a human carrier.

Yet another object of the present invention is to provide a dual strap golf bag carrying device wherein the weight of a golf bag may be simultaneously supported by both shoulders of the golf bag carrier, or alternately may be carried by a single strap on one shoulder, if desired, in the traditional manner.

A still further object of the present invention is to provide a dual strap carrying device for golf bags that is easy and convenient to use and is more comfortable for the carrier of a set of golf clubs.

Yet another object of the present invention is to provide a dual strap carrying device for golf bags that is helpful for the carrier of a set of golf clubs and which is adjustable to accommodate different physiques.

According to the present invention, then, a golf bag carrying system is provided in the form of a dual strap carrier device that may be manufactured either in conjunction with the construction of a golf bag, as original equipment, or which may be manufactured as a retro-fit system attachable to a standard golf bag assembly. To this end, in its broad form, the present invention is in the form of a strap assembly for use with a golf bag wherein the golf bag is in the form of an elongated tubular member having a surrounding sidewall, an enclosed end and an open end whereby the shafts of golf clubs made be inserted into the golf bag. The strap assembly includes a first strap having a first strap end secured to the golf bag at a first location proximate the open end and having a first strap second end secured to the golf bag at a second location axially spaced from the first location along an attachment axis. The first strap thereby defines a primary strap forming a first strap opening which may be secured over one of the person's shoulders. The second strap has a second strap first end secured to the golf bag proximate the second location and has a second strap second end secured to the golf bag at a third location axially spaced from the second location along the attachment axis between the second location and the closed end of the golf bag thereby defining a second strap opening. The second strap thus forms a secondary strap which may be positioned over the other shoulder of the person so that the golf bag may be suspended from and supported by both shoulders in a fully supported state. In the fully supported state, therefore, the golf bag is oriented transversely across the back of the user.

Preferably, the first strap second end and second strap first end are fastened together to form a central portion which is secured to the golf bag at the second location. Preferably, the ends of the first and second straps proximate the central portion include flexible strap elements which help elevate the second strap when the golf bag is supported by the first strap thus facilitating insertion of a person's second arm and shoulder through the second strap opening. Further, these respective strap ends, whether with or without the flexible elements, may be structured as a unitary strip extending around a central mounting element. This central mounting element may further be connected to a releasable mounting structure on the central portion for securing the central portion of the strap assembly to the golf bag.

This strap assembly is especially useful wherein the golf bag has a handle portion located on the sidewall and extending axially between the first and third locations. The strap assembly can include a mounting web and buckle so that a free end of the mounting web can wrap around the handle to attach the central portion thereto. Thus, the handle defines the second location for attachment of the strap assembly to the golf bag. The location of this attachment can be at a selected place axially along the handle to define the primary balance point for carrying the golf bag. The first strap first end may include a first releasable mounting means, such as a swivel clip, and the second strap second end may include second releasable mounting means such as a second mounting clip, so that the ends of the strap assembly opposite the central portion may be releasably attachable to the golf bag respectively at the first end third locations. Further, the first and second straps may include adjustment elements for adjusting their respective effective lengths, and the first and second straps may be provided with pads operative as cushions on the persons shoulders. The central portion of the first and second straps, including their associated pads, may be arcuate to provide greater comfort and to facilitate the positioning of the straps on the carrier's shoulders. To this end, also, the golf bag may be provided with a pillow element circumferentially offset from the attachment axis approximately ninety degrees to rest against the back of the person when the golf bag is in a fully supported state with both of the first and second straps extending across respective shoulders of the golf bag carrier. Alternatively, a concavity may be formed in the golf bag so that it is contoured to the lower back. Auxiliary compartments may be provided on the exterior of the golf bag to carry auxiliary golf equipment. In addition, a wedge-shaped structure may be mounted at the upper end of the golf bag to help prevent dislodgment of the golf clubs from the golf bag when it is carried.

The strap assembly described above may be employed with existing golf bags having a top mounting element, a handle and a bottom mounting element wherein the top and bottom mounting elements traditionally secure a unitary carrying strap for such traditional golf bags. However, this strap assembly may also be implemented with a specially constructed golf bag wherein a different structure is utilized for the upper and lower mounts. For example, in the exemplary embodiment of the present invention, a first mount located proximate the open end of the bag is in the form of a first mounting strip extending circumferentially around at least a portion of the tubular body on either side of the attachment axis and a first slide ring slideably received on this first mounting strip so that the mounting ring is movable along the first mounting strip to locations circumferentially on either side of the attachment axis. The bottom mount, at the third location, may include a second mounting strip extending circumferentially around at least a portion of the tubular body on either side of the attachment axis and a second slide ring slideably receive don the second mounting strip so that it is movable to locations circumferentially on either side of the attachment axis. This second mounting strip may be movable longitudinally of the tubular body to adjust for different shoulder widths and may extend completely around the tubular body to cradle the tubular body when the golf bag is fully supported. The first mount may also be positioned and secured at selected longitudinal locations. By forming this central mount, at the second location, as a handle element, the position of mounting of the central portion to the golf bag may be selectably adjusted therealong. If desired, a linking cord may extend between the central portion of the strap assembly and the second strap free end, secured at the third location, so that, when the carrier desires to carry the golf bag solely by the first strap, carrying forces are transferred from the central portion to the third location.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to a golf bag assembly that uses a new and useful strap assembly enabling a golfer or other person to conveniently carry a golf bag on both shoulders although the structure described allows carriage of the golf bag on a single shoulder as well. In the broad form, the present invention is described either as a strapping assembly that may be manufactured as original equipment on a golf bag or which may be manufactured separately as a retro-fit attachment to existing golf bags. In either case, the invention, when used in conjuction with the golf bag, broadly includes a pair of straps which are connected to and oriented longitudinally along a golf bag to define an attachment axis. A first strap has a first strap first end connected to an upper portion of the golf bag and a first strap second end connected to a mid-portion of the golf bag that is longitudinally spaced from the upper portion. The second strap has a second strap first end that is connected to the mid-portion of the golf bag at or proximate to the location of the attachment point of the first strap second end. The second strap has a second strap second end that is connected to a lower portion of the golf bag longitudinally spaced from the mid-portion. These straps may then be mounted respectively over the left and right shoulders of a person who is to carrying the golf bag so that the weight of the golf bag is suspended from both of the persons shoulders to hang in an orientation across the person's back.

Figure 1:
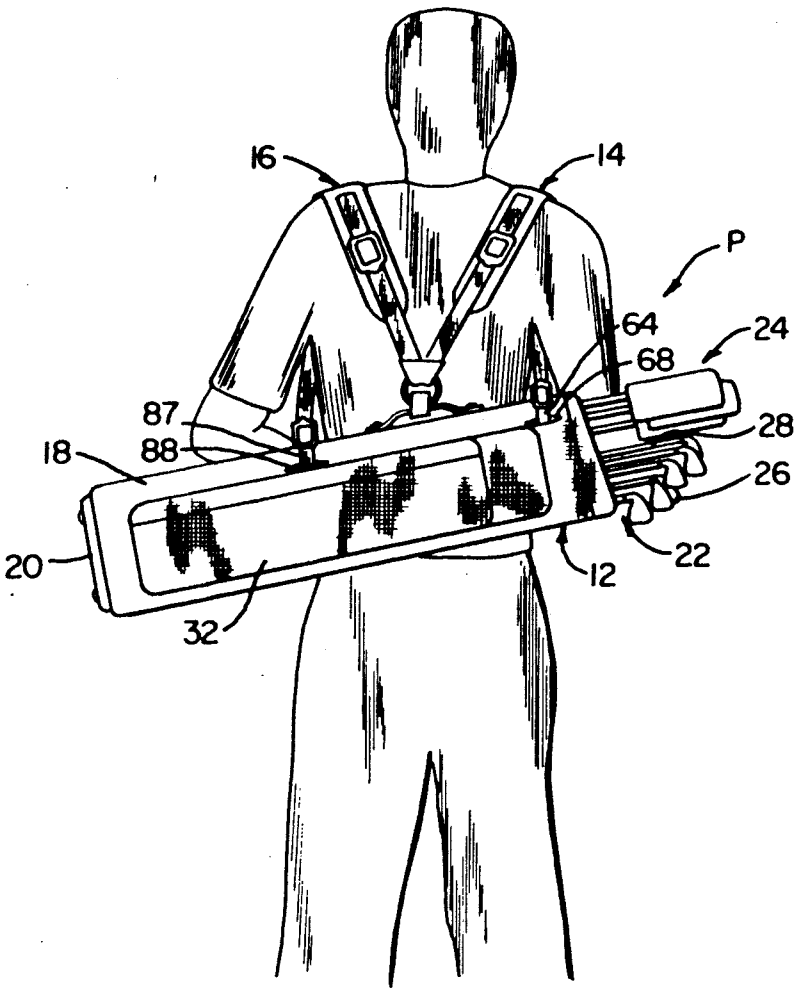
FIG. 1 is a perspective rear view of a person carrying a golf bag utilizing the present invention with the golf bag shown in a fully supported state for a right hand orientation.

The exemplary embodiments of this invention may best be seen with respect to the figures. In FIG. 1, for illustration purposes, it is seen that a person carries a golf bag 12 according to the present invention in a fully supported state by a first strap 14 and a second strap 16. Golf bag 12 is in the form of an elongated tubular body having a surrounding sidewall 18, a closed end 20 and an open end 22 so that set of golf clubs 24 may be inserted in golf bag 12 for storage and transport. To this end, each golf club of the set of clubs 24 includes a head, such as head 26 and a shaft, such as shaft 28. Auxillary compartments 30 and 32 are provided to permit transport of auxiliary golf equipment and, as noted below, are oriented to permit balancing of the weight of the golf bag and clubs.

Figure 2:
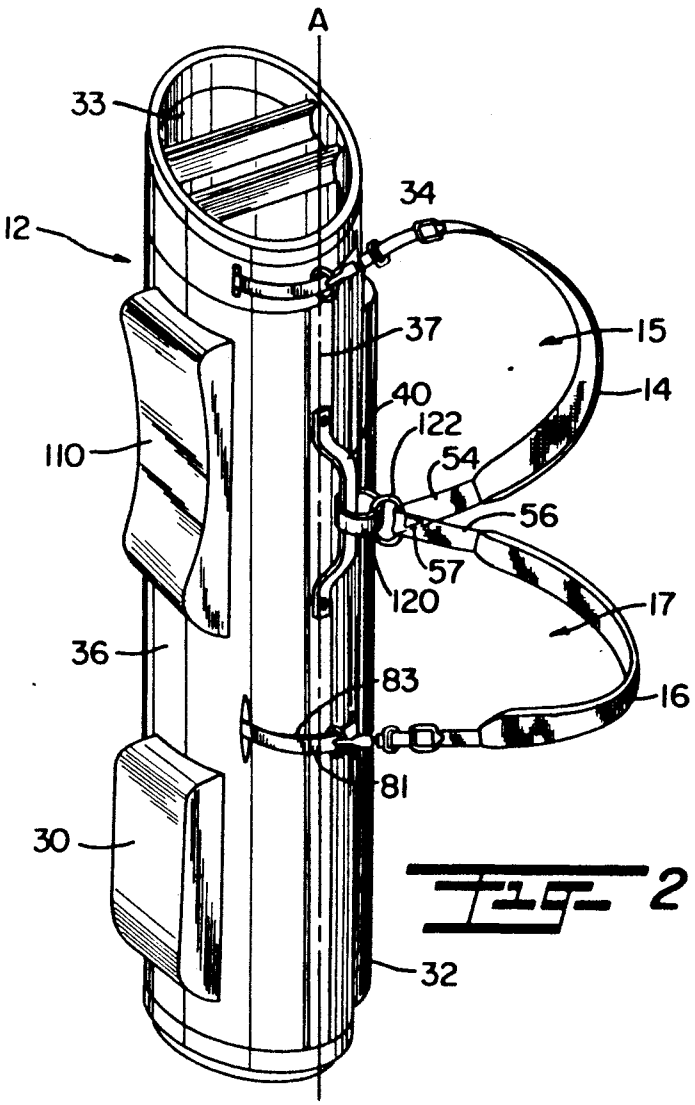
FIG. 2 is a perspective view of a golf bag assembly according to the present invention with a back pad secured thereto.

The golf bag structure implementing the present invention is shown in greater detail in FIGS. 2–6. In these figures, it may be seen that golf bag 12 has a central handle 40 located at a mid-portion of golf bag 12. First strap 14 defines a primary strap and has a first strap first end 52 which is secured to golf bag 12 at a first location along an upper end portion 34 adjacent open end 22. A second end 54 of first strap 14 is secured to golf bag 12 at a second location along a mid-portion thereof, and, to this end, second end 54 is secured to handle 40 as more thoroughly described below. Second strap 16 has a first end 56 secured to a mid-portion of golf bag 12, specifically to handle 40, and second strap 16 has a second end 58 secured to golf bag 12 at a third location longitudinally spaced from the point of attachment of ends 54 and 56 toward a lower portion of golf bag 12. Thus, as shown in FIG. 2, the first, second and third locations define a longitudinal attachment axis A. A wedge-shaped structure 33 is mounted in open end 22 diametrically opposite axis A and operates to help prevent inadvertent dislodgment of the golf clubs from golf bag 12 during use.

Figure 3:
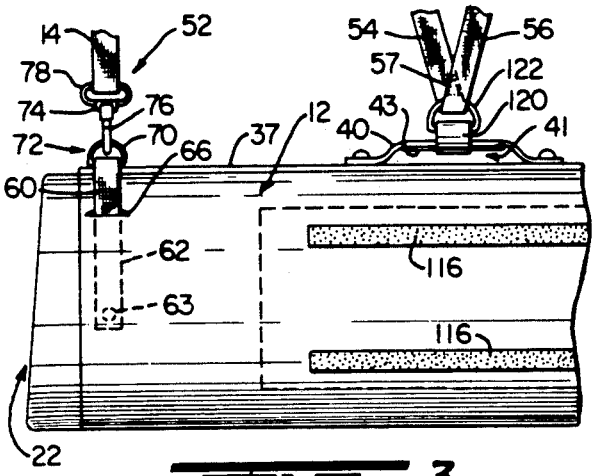
FIG. 3 is a side view in elevation showing the top portion of the golf bag of FIG. 2 with the back pad removed.
Figure 4:
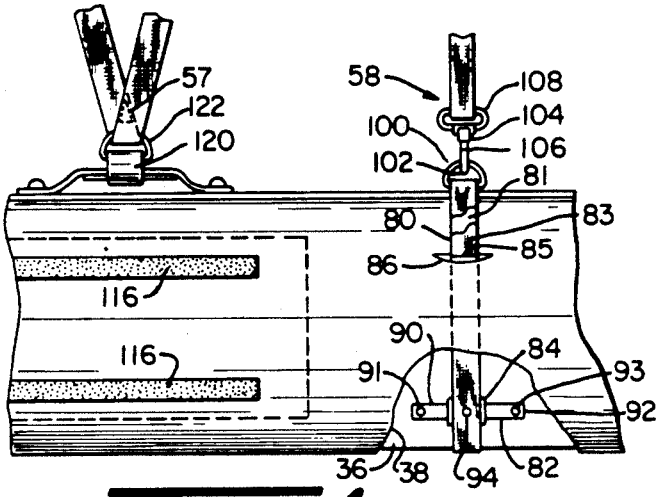
FIG. 4 is a side view in elevation and partially broken away of a mid-portion of the golf bag shown in FIG. 2 with the back pad removed.

As may be seen with greater particularity with reference to FIGS. 2–4, golf bag 12 may include a cylindrical shell 36, which is typically a plastic tube joined at a spine 37. Shell 36 is covered by a covering 38 of cloth, vinyl and the like. A first circumferential mounting strap 60 has end portions 62 and 64 secured at opposite diametric locations on upper end portion 34 of golf bag 12. As is shown in phantom in FIG. 3, this may be to shell 36 by means of a rivet 63 or other convenient form of attachment. Accordingly, end portions 62 and 64 of strap 60 extends through slits 66 and 68, respectively, in covering 38, so that they may be secured to cylindrical shell 36. Alternately, mounting strap 60 could extend completely around shell 36 to cradle golf bag 12.

As is best shown in FIG. 3, first strap 14 is mounted to golf bag 12 by means of a mounting ring 70 which is slideably mounted on strap 60 and can move circumferentially on either side of attachment axis A. To this end, strap 60 is received through opening 72 in mounting ring 70. Clasp 74 is a swivel clip having a clip head 76 that may be releasably fastened onto mounting ring 70 and, at the opposite end from head 76, includes a ring 78 to which a webbing strip is secured, as discussed below.

Turning to FIG. 4, it may be seen that the second end 58 of second strap 16 is mounted to golf bag 12 by means of a second circumferential mounting strap 80 which extends completely around to cradle golf bag 12. Strap 80 passes through slits 86 and 88 in covering 38 on opposite sides of golf bag 12, as is shown in FIGS. 1 and 4, with slits 86 and 88 being each offset approximately thirty degrees circumferentially of attachment axis A. Strap 80 preferably includes two strap sections 81 and 83 secured together at ends 85 and 87, respectively, and strap 80 is mounted for limited longitudinally sliding movement by means of a longitudinal band 82 which has opposite ends 90 and 92 riveted to cylindrical shell 36 by means of rivets 91 and 93, respectively. A slide bracket 84 is slideably mounted on band 82 for longitudinal sliding movement between rivets 91 and 93, and mounting strap 80 is attached to slide bracket 84 by means of a rivet 94. A mounting ring 100 has an opening 102 that receives mounting strap 80 so that mounting ring 100 may slide circumferentially between strap sections; 81 and 83 and between circumferential limits defined by attached ends 85 and 87. A swivel clip 104 includes a clip head 106 that may be releasably fastened onto mounting ring 102 and a ring 108 is located oppositely clip head 106 to receive a webbing strip again as discussed below.

Second end 54 of first strap 14 and first end 56 of second strap 16 are each secured at a location that is longitudinally spaced between mounting straps 60 and 80. In the preferred embodiment, these ends are attached together to form a central portion of the strap assembly and connection to golf bag 12 is accomplished to handle 40 by means of a single releasable mounting strap assembly 120 described below in greater detail. To this end, however, mounting strap assembly 120 includes a large D-ring 122 and, as may be seen in the embodiment of FIG. 2, ends 54 and 56 are secured to one another and around D-ring 122 by means of stitching 57.

It may be seen from the foregoing that first strap 14 is secured at a first location proximate the open end 22 of golf bag 12 and at a second location longitudinally spaced from the first location so that first strap 14 defines a first strap opening 15 sized to accommodate one of the shoulders of a person who seeks to carrying golf bag 12. Second strap 16 has a first end 56 thus secured to the golf bag at the second location and has a second end 58 secured at a third location longitudinally spaced from the second location between the second location and closed end 20 to define a second strap opening 17 sized to receive the other shoulder of the person who seeks to carry golf bag 12. Accordingly, a person may carry the golf bag by inserting both arms respectively through strap openings 15 and 17 so that the golf bag 12 may be supported by the shoulders and suspended transversely across the back, as is shown in the right hand orientation of FIG. 1. It should be understood, however, that the golf bag could be carried with the club heads projecting to the left, that is, in a left hand orientation opposite that orientation, shown in FIG. 1 with the structure described herein reversed as would be evident to the ordinarily skilled person in this field of invention.

Figure 5:
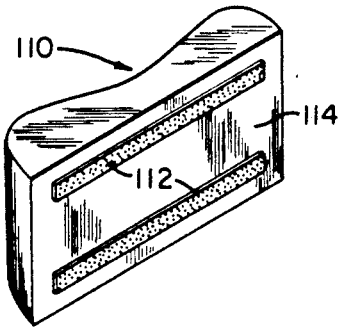
FIG. 5 is a rear perspective view of the back pad according to the present invention used in conjunction with the golf bag of FIG. 2.

To further increase the comfort of carrying golf bag 12, a back cushion or pillow may be provided, if desired, with this pillow 110 being illustrated in FIG. 5. Here, pillow 110 may be constructed of any cushioning material or construction and is preferably concave in shape to conform to the human back. Pillow 110 includes a pair of mating hook and loop fasteners including strips 112 oriented longitudinally across its back panel 114. Mating velcro strips 116 are longitudinally oriented on the exterior of sidewall 18 of golf bag 12 circumferentially offset from the attachment axis A. Strips 112 are preferable filaform elements while strips 116 are the matching loop elements defining the mated pair. Strips 116 extend from a location approximately mid-way between the first and second attachment locations of first strap 14 to a location approximately midway between the points of attachment of second strap 16. Pillow 110 is secured to golf bag 12 by the mating action of strips 112 and 116 so that it is centrally positioned on the back of the wearer when golf bag 12 is mounted in the position shown in FIG. 1.

Figure 6:
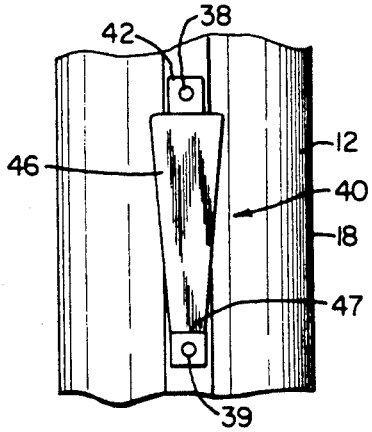
FIG. 6 is a front view in elevation of the handle portion of the golf bag shown in FIG. 2.

Handle 40 is best shown in FIG. 6 where it may be seen that handle 40 has opposite handle ends 42 and 44 which are respectively secured to sidewall 18 of golf bag 12 by rivets 38 and 39. Handle 40 has a central portion 46 that is tapered so that it is narrower at the end 47 thereof proximate closed end 20 and is wider at the end 48 thereof proximate open end 22. As described below, this construction helps facilitate the use of first strap 14 independently of second strap 16.

Figures 7A, 7B, 7C, 7D:
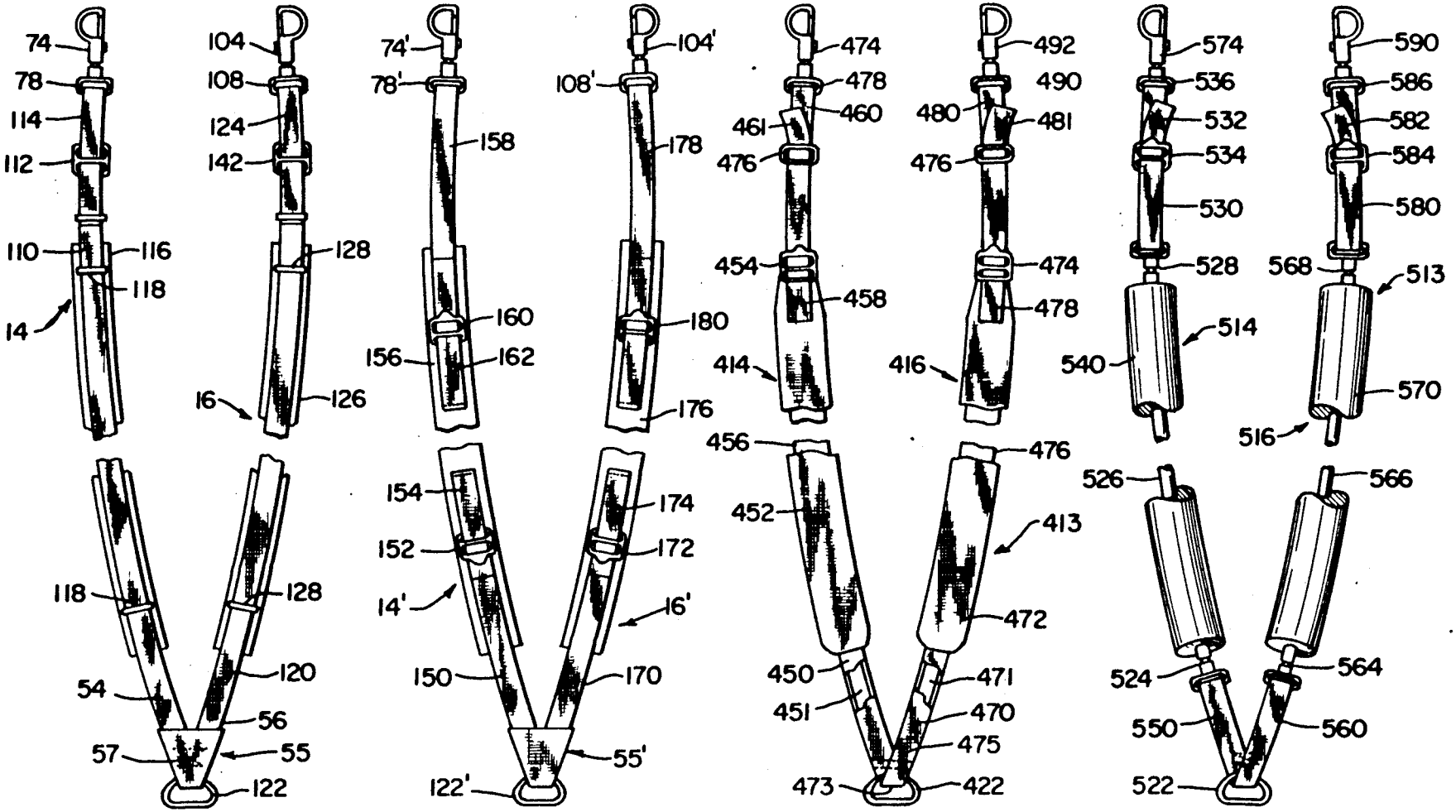
FIG. 7(*a*)–7(*e*) show alternate embodiments of the dual strap assembly used with a golf bag according to the present invention.

Turning, therefore, to the assembly of first and second straps 14 and 16, reference may be made first to FIG. 7*a* which shows a first embodiment of this strap assembly 13. Here, it may be seen that first strap 14 is constructed utilizing a primary webbing strip 110 which extends from D-ring 122 at central portion 55 to a terminus at buckle 112; a second webbing strip 114 which extends from buckle 112 to ring 78 which forms part of swivel clip 74. An enlarged elongated cushion or pad 116 is mounted to primary webbing strip 110 by means of a plurality of loops, such as loops 118 to provide additional support and comfort to the persons shoulders. Pad 116 may be constructed in any convenient manner; for example, pad 116 may be a foam filled nylon tube or may be laminated as layers of different foam material, as is readily known in the art. Utilization of primary webbing strip 110 connected to secondary webbing strip 114 by buckle 112 allows for the adjustment of the effective length of first strap 14.

Likewise, second strap 16 includes a primary webbing strip 120 which extends from D-ring 122 to buckle 124. A secondary webbing strip 124 then extends from buckle 124 to ring 108 on swivel clip 104. An enlarged elongated cushion or pad 126 is mounted by means of loops 128 to primary webbing strip 120, again, to increase comfort for the wearer when carrying golf bag 12. This pad 126 is constructed in any manner well known in the art, as described with respect to pad 116 above. Adjustment is again accomplished by buckle 124 so as to accommodate different sizes of persons carrying golf bag 12. As is also shown in FIG. 7(*a*), strips 110 and 120 may be a unitary strip folded around D-ring 122 and reinforced by piece 59.

Figure 7E:
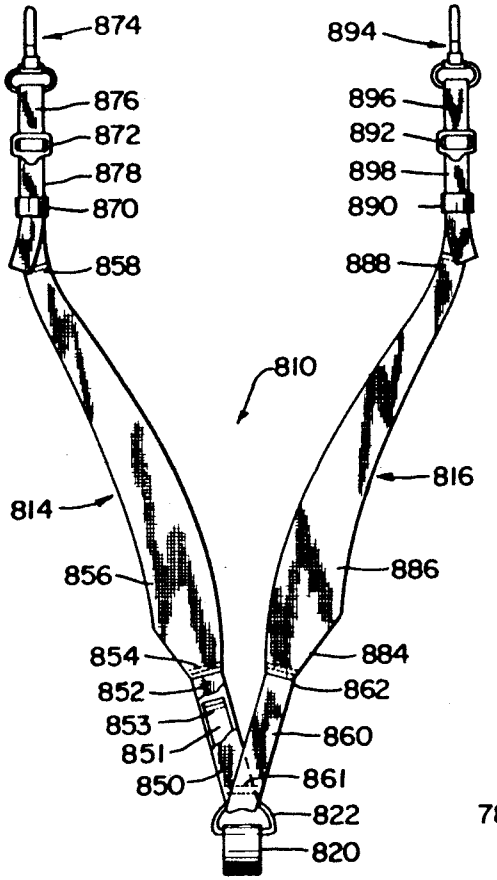

An alternate embodiment of the strap assembly is shown in FIG 7(*b*). Here, a strap assembly 13' includes a first strap 14' and a second strap 16'. Strap 14' includes a webbing strip 150 which extends from D-ring 122' at central portion 55' to a first adjustment buckle 152 which is secured to an enlarged elongated pad 156 by means of webbing strip 154. Similarly, a secondary webbing strip 158 extends from ring 78' of swivel clip 74' to a second adjustment buckle 160 which in turn is secured to pad 156 by means of webbing strip 162. Likewise, second strap 16' includes a primary webbing strip 170 that extends from D-ring 122' to a third adjustment buckle 172 which is secured to enlarged elongated pad 176 by means of a webbing strip 174. A secondary webbing strip 178 extends from ring 108' of swivel clip 104° to a fourth adjustment buckle 180 secured to pad 176 by means of webbing strip 182. The ends of primary webbing strips 150 and 170 are attached, therefore, to D-ring 122' and a reinforcement piece 55' is folded around these ends and D-ring 122' to further increase the strength of attachment. It may thus be seen from FIG. 7(*b*) that the alternate embodiment shown therein and described above allows for four points of adjustment so that the effective length of straps 14' and 16' may be varied while maintaining their respective pads 156 and 176 in a centralized location. Naturally, other constructions of straps 14, 14', 16 and 16' to provide other means for adjustment are well within the scope of the invention.

Another embodiment of the strap assembly is shown in FIG. 7(*c*). Here, strap assembly 413 includes a first strap 414 and a second strap 416. Strap 414 includes a tubular webbing strip 450 which extends from a D-ring 422 to be secured to a larger tubular webbing strip 452. A first adjustment buckle 454 is secured to an opposite end of tubular webbing strip 452 by means of a secondary webbing strip 458 that is stitched to webbing strip 452. Buckle 454 adjustably receives webbing strip 460 which extends around ring 478 of a swivel clip 474, and ring 476 is provided to retain the tail 461 of webbing strip 460. Enlarged tubular strip 452 mounts therein a pad or cushion 456 which may be of any suitable form or laminate form material. Tubular webbing strip 450 receives a resilient element 451 in the form of a strip of resilient plastic material. Second strap 416 of strap assembly 414 is constructed similarly to first strap 414 and includes a first tubular webbing strip 470 which extends from buckle 422 to webbing strip 472 that receives a cushion or pad 476. At an opposite end, webbing strip 472 is secured by a secondary webbing strip 478 to an adjustment buckle 474 that receives a webbing strip 480 that is reversed upon itself to have a tail 481 secured by buckle 476. Webbing strip 480 mounts to ring 490 of swivel clip 492. Webbing strip 470 receives a plastic resilient element 471. It should be appreciated that, in the construction shown in FIG. 7(*c*) webbing strips 450 and 470 are formed as a unitary strip that is folded about itself to form a reverse 473 that receives D-ring 422 with this reverse being secured around ring 422 by means of stitching 475. The function of resilient strips 451 and 471 may be now more fully appreciated. When the person utilizing strap assembly 413 first mounts the golf bag on ones shoulder using first strap 414, resilient element 471 acts to partially hold open the second strap opening thereby facilitating mount insertion of the persons other arm and shoulder through the second strap opening. Accordingly, rather than merely dangling along side the golf bag so that mounting of the golf bag on the second shoulder is difficult, second strap 416 will be elevated so that the user may conveniently insert his/her arm through the second opening and thereby hoist the golf bag onto his/her back.

A fourth embodiment of the strap assembly is shown in FIG. 7(*d*). Here, a first strap 514 has a web strip 550 attached to D-ring 522 and, at an opposite end, to a swivel connector 524. Swivel 524 is connected to a cord 526 so that cord 526 really rotates with respect to connector 524. The opposite end of cord 526 is connected to swivel 528 which is in turn connected to web strip 530. Web strip 530 is connected to another web strip 532 by means of an adjustable buckle 534, and web strip 532 connects swivel 536 of clip 574. A tubular foam piece 540 is mounted over cord 526 between swivel connectors 524 and 528. Accordingly, it may be appreciated that foam roller 540 may freely rotate on the axis defined by swivel connectors 524, 528. Likewise, strap 516 includes a web strip 560, which may be integral with web 550. Web strip 560 is connected at one end to D-ring 522 and at the other end to a swivel connector 564. Swivel connector 564 is connected to a cord 566 and, the other end to a swivel connector 568. Cord 566 freely rotates with respect to swivels 564 and 568, and a tubular foam piece 570 is mounted on cord 566 for free rotation therewith. Swivel connector 568 is also connected to a web strip 580 that is connected to a web strip 582 by means of an adjustable buckle 584. Web strip 582 terminates at swivel connector 586 and clip 590. From which this description, it should be appreciated that mounting strap assembly 513 is easily mounted on the shoulders since, when the arm and shoulder is inserted through a respective strap opening, foam pieces 540 and 570 define rollers that will roll over articles of clothing to prevent binding, snagging and the like.

A final embodiment of the strap assembly according to the present invention is shown in FIG. 7(*e*). This strap assembly 810 includes a first strap 814 and a second strap 816 which are constructed to give even further comfort to the carrier. First strap 814 has a web strip 850 which is attached to a D-ring 822 and, at an opposite end, to a central padded strap 586 at stitching 854. Webbing strip 850 is a tubular and contains a resilient plastic strip 851 which is sewn in place by stitching 853. However, strip 851 does not extend the entire length of webbing strip 850 so that an end portion 852 of webbing strip 850, adjacent pad 856, does not contain an end portion of plastic strip 851. Similarly, second strap 816 includes a webbing strip 860 that is secured to D-ring 822 and is connected to a central pad 886 at stitching 884. Webbing strip 860 contains a plastic strip (not shown) similar to strip 851 pad 886. It may seen in FIG. 7(*e*), and as described above, that webbing strips 850 and 860 are preferably a singular piece of webbing which extends around D-ring 822 and is sewn to itself by stitching 861. Likewise, resilient plastic strip 851 would extend around D-ring 822 inside of the common tubular webbing strip 850, 860.

D-ring 822 carries the releasable strap assembly 820. Each of straps 814 and 816 each respectively have adjustable mounting straps at a distal end opposite D-ring 822. For example, strap 814 has a webbing strip 878 which is secured to end 858 of pad 856 and receives an adjustable buckle 872 so that a tail of strip 878 may be doubled back on itself and held in position by sleeve 870. Buckle 872 mounts another webbing strip 876 which is secured to swivel clasp 874. Accordingly, it may be seen that the effective length of strip 878 may be varied to change the effective length of strap 814. Similarly, second strap 816 has a webbing strip 898 at end 888 of pad 886. Buckle 892 is secured to strip 898 and a tail of strip 898 is doubled back on itself and is retained by sleeve 890. Buckle 892 mounts a webbing strip 896 which in turn secures swivel clasp 894. The webbing strip 898 may be adjusted to change the effective length of strap 816.

Figure 8:
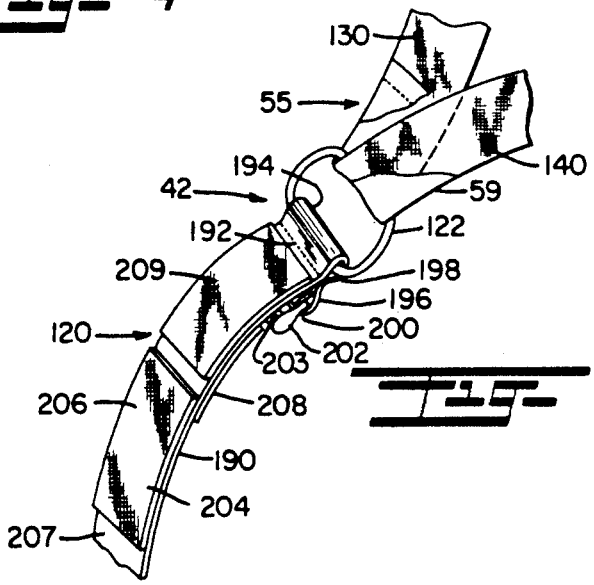
FIG. 8 is a perspective view partially broken away of the central releasable mount unused in the present invention.

Several advantages are shown in the structure of the strap assembly in FIG. 7(*e*). It may be noted with reference to pads 856 and 886, that they are arcuate in shape so as to extend across a carrier shoulder in a flatter profile and closer to the carrier's neck. Thus, when the golf bag is supported, straps 814 and 816 will extend generally upwardly and the forwardly across the person's shoulders in the flat profile. The straps 814 and 816 then extend downwardly and outwardly after which they extend rearwardly under the respective arm of the person to where they are secured to the golf bag. By curving the straps the central pads 856 and 886 in the manner shown in FIG. 7(*e*), straps 814 and 816 more readily stay on the wearer's shoulders since the weight of the golf bag does not tend to pull the straps laterally off of the shoulders. To this end also, end portions 852 and 862 of webbing strips 850 and 860 are provided without the plastic inserts such as shown in FIG. 7(*c*). This construction again allows more flexibility of straps 814 and 816 at web portions 852 and 862 proximate the respective central pad so that the straps 814 and 816 may flex and twist along web portions 852 and 862. This provides greater comfort to the wearer since straps 814 and 816 will now rotate more freely with the trunk of the body as the wearer is ambulatory. These flexible portions 852 and 862 facilitate mounting of the golf bag onto the shoulders since plastic strip 851 helps hold the straps open for insertion of the arms at the same time do not resist insertion due to the resiliency of strip 851. Also, it should be understood that one of central pads 856, 886 may be covered by a covering that is relatively slick with respect to a person's clothing while the other can be covered with a material that resists slippage with respect to a person's clothing. Thus, for example, pad 886 has a vinyl, nylon or similar covering 887 that readily slides on clothing while pad 856 has a cloth covering 857 that resists slippage. When used, strap 814 will be easily retained on the selected shoulder because of the friction of pad 856 while strap 816 will readily slide over the other shoulder due to the slick nature of covering 887. The attachment of the various strap assemblies, such as shown in FIGS. 7(*a*) –7(*e*), may be accomplished by connecting the central portion thereof to handle 40 by means of the releasable strap assembly 120, best shown in FIG. 8. Here, it may be seen that releasable strap assembly 120 is secured, by way of example, to D-ring 122 by means of a primary webbing strip 190 that is folded about itself and sewn at 192 to create the sleeve 194 that receives D-ring 122. A reverse 196 is provided at a short end 198 of strip 190 to form a sleeve 200 that mounts a buckle 202. Long end 204 of webbing strip 190 is provided with a first strip 206 of filaform elements adjacent free end 207 thereof. A second strip 208 of filaform elements is mounted on a side of webbing strip 190 opposite filaform strip 206, with filaform strip 208 being located centrally between free end 207 and sleeve 194. A strip of loop elements 209 is mounted on webbing strip 190 on adjacent sleeve 194 and on the same side of strip 190 as filaform strip 206.

With reference, then, to FIG. 3, for example, it may be seen that strap assembly 42 may be utilized to secure D-ring 122 to handle 40. Here, free end 207 is inserted through handle opening 41 so that filaform strip 208 engages loop strip 43 mounted to the underside of handle 40. Free end 207 is then inserted through slot 203 in buckle 202, from the inside out, so that it may be reverse folded about itself and passed again through handle opening 41 where it may then be wrapped around handle 40 to engage loop strip 209 on webbing strip 90. The excess tail, if any, of free end 207 may then be inserted through D-ring 122, if desired.

From the foregoing, it may be seen that the golf bag and strapping assembly according to the present invention may be readily employed to facilitate the transport of a golf bag by means of a person during the game of golf. A strap assembly, such as strap assembly 13, is then secured to handle 40 at D-ring 122 in the manner described above at a selectably adjustable longitudinal location to balance the golf bag and clubs. Swivel clips 74 and 104 are respectively attached to D-rings 70 and 100 so that, for the desired orientation of golf bag 12, pads 116 and 126 will overlay the shoulders. The distance between first strap first end 52 and first strap second end 54 is selected by the point of attachment of strap assembly 42 to handle 44 to accommodate the width of the shoulders, and the effective lengths of straps 14 and 16 are adjusted for the length of the person's torso, as desired for comfort. The distance between from second strap first end 56 and second strap second end 58 is automatically adjusted since the position of circumferential mounting strap 80 may be adjusted in location by means of slide bracket 84 sliding on band 82. It may be further seen that circumferential positioning is automatically accommodated by the slippage of D-rings 70 and 100 circumferentially around their respective mounting straps 60 and 80.

It may be seen that handle 40 also provides a convenient "one-handed" lift for golf bag 12 when the golf bag is not worn on the shoulders. Further, for carrying golf bag 12 a short distance, it is sometimes desirable that a single carrying strap be used. To this end, first strap 14 provides a primary carrying strap that may be placed over one of the person's shoulders and strap 16 is left in a dangling state. It may now be appreciated that the tapered construction of handle 40 shown in FIG. 6, helps prevent any slippage of releasable strap assembly 42 longitudinally of central portion 46 of handle 40. That is, once releasable strap assembly 13 is mounted on handle 40, the increasing width of central portion 46 and the resistance of releasable strap assembly 120 to any increase its size once it is wrapped around handle 40 and secured prevents upward longitudinal slippage.

From the foregoing, it may also be readily appreciated that different attachment structures can be provided for mounting straps 14 and 16 and that strap assembly 13 can be provided with other mounting strap construction, as would now be recognized by the ordinarily skilled person in this field of endeavor. Two such embodiments are shown respectively in FIG. 9–10 and FIG. 11. Further, FIG. 12 shows a mounting strap assembly that may be used as a convenient retrofit on a wide variety of existing golf bags. The essential feature of the present invention, therefore, should be understood to be the inclusion of a pair of shoulder straps on golf bag with these shoulder straps being sized to accommodate both shoulders of the wearer and being connected so that they each extend longitudinally of the golf bag in end to end relation.

Figure 9:
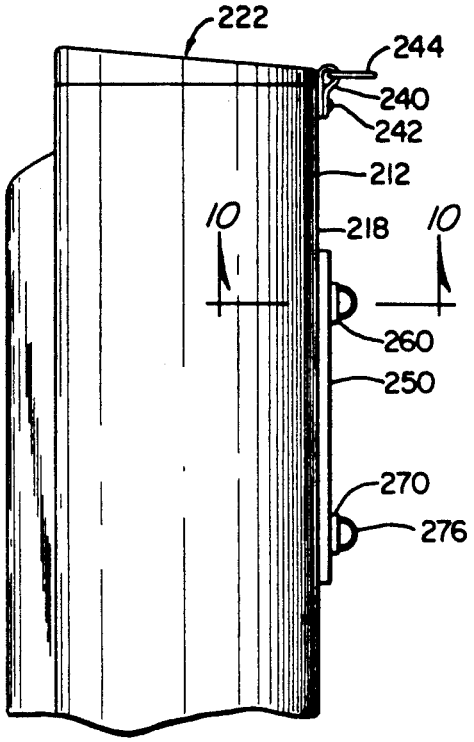
FIG. 9 is a side view in elevation of an alternate embodiment of the central and lower mounts according to the present invention for use with the golf bag.
Figure 10:
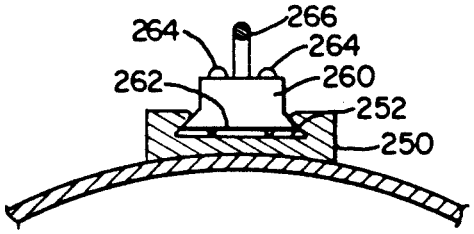
FIG. 10 is a cross-sectional view taken about lines 10—10 of FIG. 9.

Turning, therefore, to FIGS. 9 and 10, it may be seen that mounting straps 60 and 80 have been eliminated as has handle 40. Instead, a first attachment structure is provided for a golf bag 212 in the form of a loop 240 riveted by rivet 242 proximate open end 222 of golf bag 212. Loop 240 mounts a metal ring 244 that provides a point of attachment, for example, for a swivel clip such as clip 74. An elongated channel piece 250 is mounted longitudinally of sidewall 218 of golf bag 212 and is provided with a pair of slide elements 260 and 270 which may be adjustably positioned therein. To this end, as is seen in FIG. 10, channel piece 250 has a dove tail channel 252 formed therein and each channel piece, such as channel piece 260, includes a flared base 262 which is sized for matable sliding engagement with channel 252. A pair of locking screws 264 is provided to lock slide element 260 in position at a selected location so that an arcuate ring element 266 is positioned at a desired attachment point. The structure of slide element 270 is similar and is not shown in detail other than that it may be appreciated that ring element 276 may likewise be positioned at a desired third location for attachment of the mounting strip assembly. Accordingly, ring 276 defines a third location for attachment adapted receive, for example, swivel clip 104. In this embodiment, then, the strap assembly is modified to eliminate, for example, D-ring 122 and releasable strap assembly 120 with this structure simply being replaced by another swivel clip such as either clips 74, 104.

Figure 11:
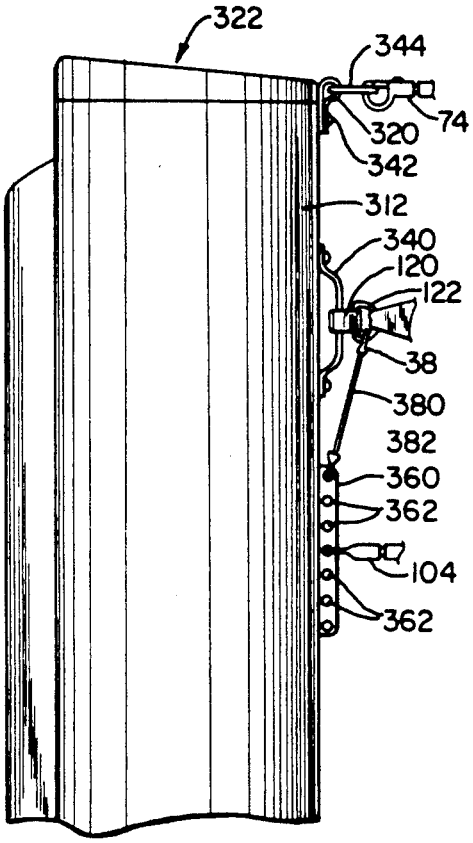
FIG. 11 is a side view in elevation of a top portion of the golf bag according to the present invention showing yet another alternate strap mounting structure.
Figure 12:
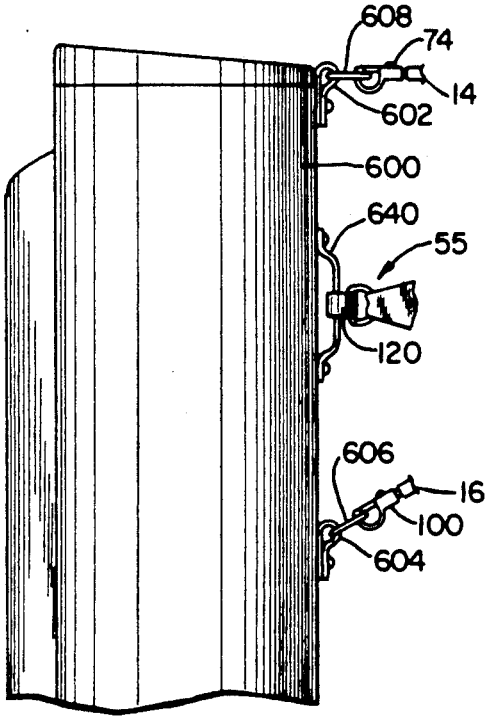
FIG. 12 is a perspective view of the strip assembly of the present invention constructed as a retrofit apparatus for standard golf bags.

A third exemplary is shown in FIG. 11. Here, modification to the bag assembly shown in FIGS. 2–8 is accomplished by eliminating mounting strap 60 and replacing it with a web loop 320 mounted by rivet 342 proximate open end 322 of golf bag 312. Web loop 340 mounts a metallic ring 344 to which a swivel clip 74 may be attached. A handle 340 is provided on bag 312 and is longitudinally spaced from web loop 320. A third point of attachment is formed by a longitudinal rib 360 provided with a plurality of openings 362 formed therein. Accordingly, swivel clip 104 may be clipped onto rib 360 by means of any selected hole 362, thereby providing selected incremental adjustment of the distance between clip 104 and the point of attachment of mounting strap assembly 42. In the embodiment shown in FIG. 11, however, handle 340 does not have the tapered construction of handle 40 shown in FIG. 6. Accordingly, in order to prevent upward sliding movement of mounting strap assembly 42, a cord 380 is provided and is secured at one end 382 to D-ring 122 and, at its other end to a clip 382 which may be clipped into any of the selected mounting holes 362. Thus, the length of cord 380 limits to a minimum the distance between first attachment point 320 and the second attachment point defined by mounting strap assembly 120. The distance between mounting strap assembly 120 and the third attachment point is then selected by the location at which swivel 104 is attached to rib 360.

The use of the present strap assembly, such is shown in the embodiments described with respect to FIGS. 7(*a*)–(*e*) may be employed with a standard construction golf bag, as is shown in FIG. 12. Here, a standard golf bag 600 has an upper connector 602 and a lower connector 604 which typically is attached to a buckle element 606. Connector 602 includes a metallic ring 608, and, in the traditional construction. A single belt which mates with buckle 606 and which includes a clip which attaches to ring 608 is normally provided as a single carrying strap. In the embodiment shown in FIG. 12, however, it may be seen that this strap may be removed and that a strap assembly according to the present invention employed. Here, for example, swivel clip 74 of first strap 14 is attached directly to metallic ring 608 while central portion 55 is attached to handle 640 by means of mounting strap assembly 120. The free end of second strap 16 is connected by means of swivel clip 100 directly to buckle 606. Thus, it may be seen that the strap assembly described with respect to the exemplary embodiments of this invention may conveniently be used on existing golf bags and thus provides an inexpensive retro-fit system employing the concepts described herein.

Figure 14:
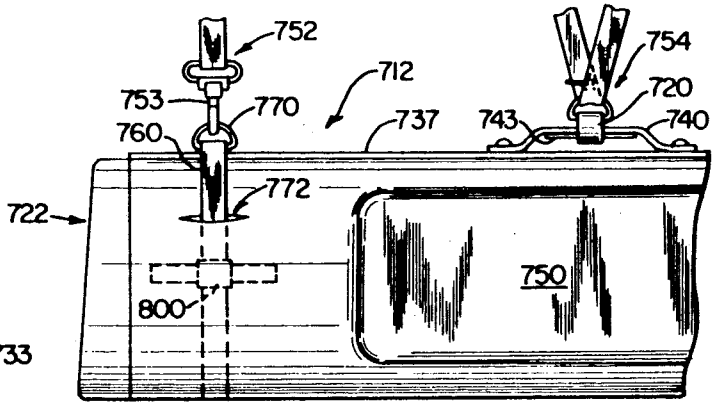
FIG. 14 is a side view in elevation showing an upper portion of the golf bag of FIG. 13.
Figure 15:
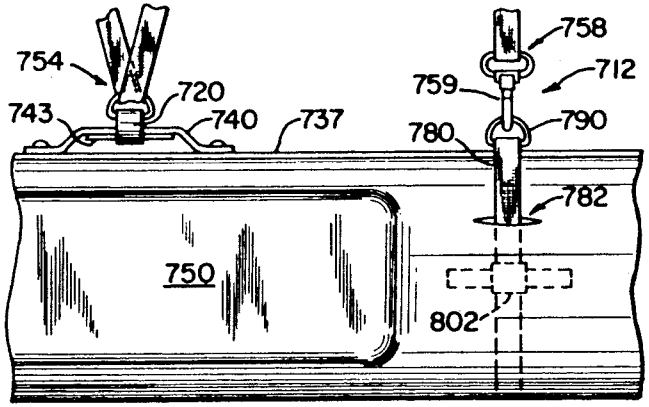
FIG. 15 is a side view in elevation showing a central portion of the golf bag shown in FIG. 13.
Figure 13:
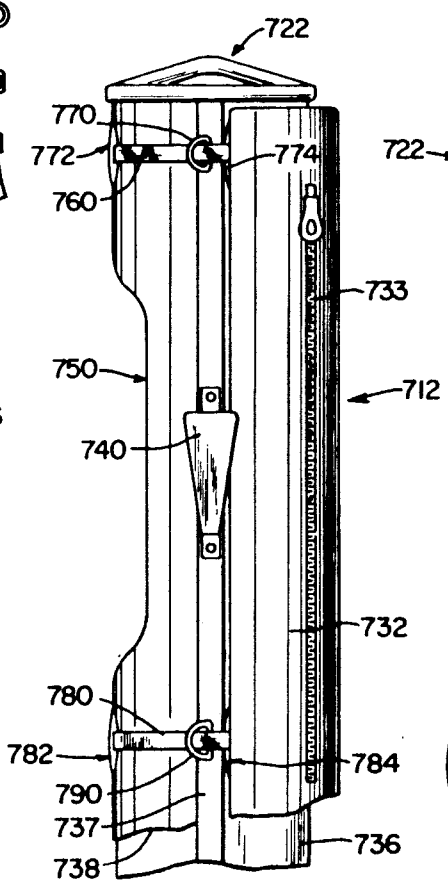
FIG. 13 is a front view in elevation of yet another alternate embodiment of a golf bag according to the present invention.

Yet another alternate embodiment of a golf bag especially constructed to implement the present invention is shown in FIGS. 13–15. Here, golf bag 712 includes a cylindrical shell 736 covered by a cloth or vinyl covering 738. Golf bag 712 has an open end 722 adapted to receive shafts of golf clubs, as set forth above, and a spine 737 extends longitudinally along the length of bag 712. Golf bag 712 is provided with auxiliary compartments, for example, a longitudinal compartment 732 is provided and extend from a longitudinal edge 734 circumferentially around the golf bag to a location generally diametrically opposite edge 734. Compartment 732 may be opened and closed by means of zipper 733.

Golf bag 712 has a central handle 740 which is secured to spine 737 as described with respect to the preferred embodiment. In order to accommodate the dual strap carrying assembly of the present invention, such as those strap assemblies described with respect to FIGS. 7(*a*)–7(*e*), golf bag 712 is provided with first and second circumferential straps 760 and 780. As may be seen in FIGS. 13 and 14, strap 760 extends circumferentially around golf bag 712 proximate open end 722 and is exposed at a region between slits 772 and 774. Slit 774 is formed in covering 738 adjacent edge 734 of compartment 732 while slit 772 is circumferentially spaced from slit 774 approximately 90° opposite compartment 772. Strap 760 may be adjustably positioned longitudinally of golf bag 712 by means of a longitudinally of adjustment assembly 800, shown in phantom, which is similar to that adjustment assembly shown in FIG. 4. Circumferential strap 760 is provided with a mounting ring 770 that receives swivel clasp 753 of a first strap first end 752, as shown in FIG. 14.

As may be seen in FIGS. 13 and 15, second circumferential strap 780 extends golf bag 712 and is exposed at a region between slits 782 and 784. Again, slit 784 is located along edge 734 of compartment 732 that is proximate spine 737 while slit 782 is circumferentially spaced approximately 90° from slit 784 in a direction opposite compartment 732. Circumferential mounting strap 780 slideably receives a D-ring 790 and may be longitudinally adjusted for position by means of a longitudinal adjustment assembly 802, shown in phantom, again similar to that adjustment assembly shown in FIG. 4. D-ring 790 mounts a swivel clasp 757 of a second strap second end 758. The location of slits 734 and 784 define limit stops for rings 770 and 790.

A central portion of the mounting strap assembly is attachable to handle 740 of golf bag 712 in a manner similar to that described above. To this end handle 740 has a loop strip 743 mounted on it underside so as to mountably engage filaform elements on releasable strap assembly 720. It should again be appreciated that the attachment of releasable strap assembly 720 to handle 740 defines the primary balance point for support of golf bag 712 when it is carried. The construction described above allows for selective longitudinal positioning of releasable strap assembly 720 along the length of handle. 740, and, once secured, the mated connection between strap assembly 720 and loop strip 743 holds the position of strap assembly 720 and thus the balance point for golf bag 712. Straps 760 and 780 can then be longitudinally adjusted for the persons physique, such as the width of the shoulders, while the length of the straps making up the strap assembly can be adjusted for the persons height.

Another feature in the golf bag 712 shown in FIGS. 13–15 is the elimination of pillow 110. Here, shell 736 is provided with a concavity 750 the contour of which is followed by covering 738. This concavity is sized and positioned to extend around the lower back of a person carrying a golf bag 712. By utilizing a concavity 750 instead of pillow 110, it may be fully appreciated that golf bag 712 rests closer against the back so that the weight of the golf bag and the set of clubs contained therein is positioned more directly over the hips of the wearer and thus is more comfortable as downward forces exerted on the shoulders. That is, the golf bag 712 is exerted downwardly and there is less tendency for the golf bag to pull the shoulders rearwardly when the bag is carried.

Accordingly, the present invention has been described with some degree of particularly directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. In a golf bag adapted to receive a set of golf clubs which each have a club head and an elongated shaft, said golf bag being in the form of an elongated tube including a surrounding sidewall, a closed end and an open end whereby the shafts of said golf clubs may be longitudinally inserted into said golf bag through the open end so that said golf clubs are stored in a position with the club heads projecting out of said golf bag proximate the open end, the improvement comprising a strap assembly adapted to permit a person to carry said golf bag on either or both shoulders, said strap assembly including a single strap comprising a first strap portion including a first central pad, a first strap portion first end attached on one end of said first central pad and a first strap portion second end attached on another end of said first central pad whereby said first strap portion has a first strap first end secured to said golf bag at a first location proximate said open end and a first strap portion second end secured to said golf bag at a second location axially spaced from the first location so that said first strap portion defines a first strap portion opening, and including a second strap portion including a second central pad, a second strap portion first end attached on one end of said second central pad and a second strap portion second end attached on another end of said second central pad whereby said second strap portion has a second strap portion first end secured to said golf bag proximate the second location and having a second strap portion second end secured to said golf bag at a third location axially spaced from the second location between the second location and said closed end to define a second strap portion opening, said first and second strap portions being sized so that one arm of the person can be inserted through the first strap portion opening and another arm of the person can be inserted through the second strap portion opening whereby said golf bag may be supported by said first strap portion extending across one shoulder of the person and by said second strap portion extending across another shoulder of the person.

2. The improvement according to claim 1 wherein said first and second central pads are arcuate in configuration so that, when said golf bag is supported, each of said central pads extends upwardly from the second location, forwardly across the shoulders of the person, downwardly and outwardly from the shoulders and then rearwardly to the first and third locations respectively.

3. The improvement according to claim 1 wherein said first strap portion second end and said secondary strap portion first end respectively include a first flexible strap element and a second flexible strap element each extending from the second location toward said first and second central pad, respectively.

4. The improvement according to claim 3 wherein each of said flexible strap elements terminate at a location spaced from the respective one of said first and second central.

5. The improvement according to claim 4 wherein said first strap portion second end and said second strap portion first end are a common webbing strip and said first and second flexible strap elements are a common strap.

6. The improvement according to claim 1 wherein one of said first and second central pads has a covering that is constructed of a relatively slick material with respect to clothing of a person.

7. The improvement according to claim 1 wherein one of said first and second central pads has a covering that is constructed of material that resists sliding with respect to clothing of a person.

8. A golf bag adapted to receive a set of golf clubs for transport by a person, comprising:

an elongated tubular body having a longitudinal axis and including a surrounding sidewall, a closed end and an open end such that golf clubs may be inserted into said tubular body through said open end;

a shoulder strap assembly including first and second shoulder strap elements, said first strap element having a first strap end portion and a first strap element free end opposite said first strap end portion and said second strap element having a second strap element end portion and a second strap element free end opposite said first end portion;

first mounting means on said golf bag at a first location, said first mounting means connected to said first strap element free end for securing said first strap free end to said golf bag at the first location;

second mounting means on said golf bag at a second location axially spaced from the first location, said second mounting means connected to said first and second strap end portions for securing said end portions to said golf bag at the second location;

third mounting means on said golf bag at a third location axially spaced from the second location between the second location and said closed end wherein, said third mounting means secures said second strap element free end to said golf bag at the third location; and said first and second shoulder strap elements sized to form first and second strap openings respectively when secured whereby the person may selectively carry said golf bag across one shoulder with only said first strap element and selectively carry said golf bag with both shoulders in a fully supported state by inserting his/her arms respectively through the first and second strap openings so that said golf bag is suspended from and supported by both shoulders with said golf bag oriented transversely across the back of the person.

9. A golf bag according to claim 8 including a concavity in said sidewall, said concavity circumferentially offset from the attachment axis approximately ninety degrees and configured to conform to the back of the person when said golf bag is in the fully supported state.

10. The improvement according to claim 8 wherein said first, second and third mounting means are selectively adjustable along the length of said golf bag.

11. A golf bag according to claim 8, wherein said first, second and third mounting means include means for releasably connecting said strap elements to said first, second, and third locations, respectively.

12. A golf bag according to claim 8, including a handle at the second location, said first and second strap elements being slidably secured to said handle, said third mounting means including an elongated rib attached to said sidewall and having axially spaced openings therein, and a cord member releasably connected at one end to one end of said axially spaced openings in said rib and at an opposite end to the second location.

13. A golf bag according to claim 8, wherein said sidewall includes an inner substantially rigid shell and an outer flexible covering in surrounding relation to said shell, said shell being of generally cylindrical configuration and provided with a generally concave depression circumferentially offset from said first and second strap elements whereby when said golf bag is supported on one or both shoulders said concave depression is in engagement with the back of the person carrying said golf bag.

14. In a golf bag to be carried by a person, a golf bag having an elongated enclosure including a surrounding sidewall, a closed end and an open end whereby golf clubs may be inserted lengthwise into said golf bag through the open end, the improvement comprising:

a shoulder strap assembly disposed externally of said sidewall including first and second strap members, each of said strap members having opposite ends;

first and second securing means for securing each of said opposite ends of said first strap member to longitudinally spaced locations on said sidewall including a first location proximate said open end and a second location longitudinally spaced from said first location whereby said first strap member defines a first strap opening through which one arm of the person can be inserted; and third and fourth securing means for securing each of said opposite ends of said second strap member to longitudinally spaced locations on said sidewall to define a second strap opening that another arm of the person can be inserted through said second strap opening whereby said golf bag can be selectively supported on one shoulder by said first strap member to incline downwardly across the back of the person carrying said golf bag and can be selectively supported on both shoulders by said first and second strap members with said golf bag extending transversely across the back of the person carrying said golf bag.

* * * * *

US005042704C1

(12) EX PARTE REEXAMINATION CERTIFICATE (7633rd)

United States Patent
Izzo

(10) Number: US 5,042,704 C1
(45) Certificate Issued: Jul. 27, 2010

(54) DUAL STRAP CARRYING SYSTEM FOR GOLF BAGS

(75) Inventor: Theodore-James Izzo, Evergreen, CO (US)

(73) Assignee: Keltic Financial Partners II, LP, Tarrytown, NY (US)

Reexamination Request:
No. 90/010,457, Apr. 22, 2009

Reexamination Certificate for:

| | |
|---|---|
| Patent No.: | **5,042,704** |
| Issued: | **Aug. 27, 1991** |
| Appl. No.: | **07/499,595** |
| Filed: | **Mar. 23, 1990** |

Related U.S. Application Data

(63) Continuation-in-part of application No. 07/460,406, filed on Jan. 3, 1990, now Pat. No. 5,038,984.

(51) Int. Cl.
*A45F 3/04* (2006.01)
*A63B 55/00* (2006.01)

(52) U.S. Cl. ..... 224/643; 206/315.3; 206/315.5; 224/644; 224/645

(58) Field of Classification Search ..... 224/643; 206/315.3, 315.5
See application file for complete search history.

(56) References Cited

U.S. PATENT DOCUMENTS

| | | | | |
|---|---|---|---|---|
| 2,820,498 A | * | 1/1958 | Endee | 224/608 |
| 2,853,111 A | | 9/1958 | Williams | |
| 3,622,056 A | | 11/1971 | Droeger | |
| 3,882,914 A | | 5/1975 | Strutz | |
| 4,074,839 A | * | 2/1978 | Wood et al. | 224/635 |
| 4,953,768 A | | 9/1990 | Muse | |

FOREIGN PATENT DOCUMENTS

| | | |
|---|---|---|
| GE | 31357 | 7/1919 |
| JP | 50-149169 | 12/1975 |
| JP | 57-149070 | 9/1982 |
| JP | 6-36843 | 12/2009 |

* cited by examiner

*Primary Examiner*—Jimmy G Foster

(57) ABSTRACT

A golf bag carrying system, in the form of a dual strap carrier, includes a first and a second strap secured to the golf bag to define arm and shoulder openings. The straps have shoulder pads, and one of which may be covered with a relatively slick material. The first strap second end and the second strap first end are attached to a mid-portion of the bag at a central location. The other ends of the first and second straps are secured to the golf bag longitudinally on opposite sides of the central location. The straps include a first and second resilient strap elements at the central location, and the resilient elements terminate at a location spaced from the shoulder pads. These resilient strap elements position thus the straps for easy access. The first, second and third mounts for securing the straps to the bag are selectively adjustable longitudinally along the bag to balance the bag and to adjust for shoulder width. Also, the pads may be laterally arcuate to facilitate wear. Furthermore, a concavity shaped structure may be formed in the bag to conform to the golfer's back.

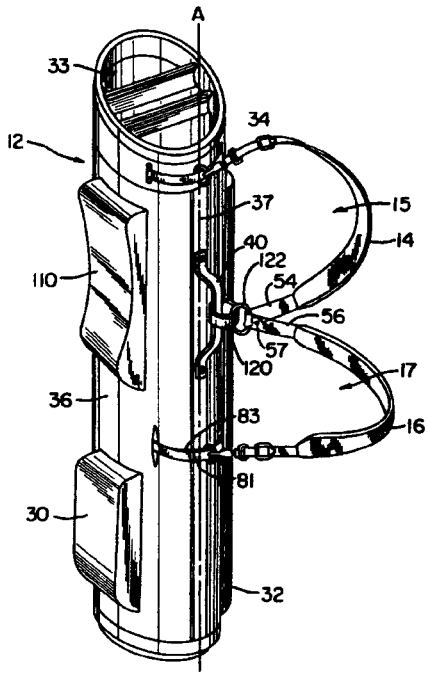

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1, 2, 7 and 14 is confirmed. Claims 3-6 and 8-13 were not reexamined.

* * * * *